US011945682B2

(12) United States Patent
Paulsen et al.

(10) Patent No.: US 11,945,682 B2
(45) Date of Patent: Apr. 2, 2024

(54) LANYARD WITH LOCKING ARM

(71) Applicant: Milwaukee Electric Tool Corporation, Brookfield, WI (US)

(72) Inventors: Alexander J. Paulsen, Milwaukee, WI (US); Andrew G. Wagner, Lisbon, WI (US); Scott M. Hangartner, Hartland, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 374 days.

(21) Appl. No.: 17/378,018

(22) Filed: Jul. 16, 2021

(65) Prior Publication Data

US 2022/0017325 A1 Jan. 20, 2022

Related U.S. Application Data

(63) Continuation of application No. PCT/US2021/041929, filed on Jul. 16, 2021.

(60) Provisional application No. 63/092,057, filed on Oct. 15, 2020, provisional application No. 63/053,068, filed on Jul. 17, 2020.

(51) Int. Cl.
*B65H 75/48* (2006.01)
*A45F 5/00* (2006.01)

(52) U.S. Cl.
CPC ..... *B65H 75/486* (2013.01); *A45F 5/004* (2013.01); *A45F 2005/006* (2013.01)

(58) Field of Classification Search
None
See application file for complete search history.

(56) References Cited

U.S. PATENT DOCUMENTS 3,165,059 A 1/1965 Saunders
5,245,761 A * 9/1993 Waldherr ..... G01B 3/1005 242/381.3
5,423,494 A * 6/1995 Kondo ..... B65H 75/44 242/381.5
5,471,761 A * 12/1995 Cheng ..... G01B 3/1005 33/767
5,513,785 A * 5/1996 Campagna, Jr. ..... F41C 33/04 224/912

(Continued)

FOREIGN PATENT DOCUMENTS

CN 207856105 9/2018
DE 1938245 5/1966

(Continued)

OTHER PUBLICATIONS

International Search Report and Written Opinion for International Application No. PCT/US2021/041929, dated Nov. 4, 2021, 11 pages.

*Primary Examiner* — William A. Rivera
(74) *Attorney, Agent, or Firm* — Reinhart Boerner Van Deuren s.c.

(57) ABSTRACT

A lanyard having a locking mechanism is provided. The lanyard locking mechanism actuates between a locked position and an unlocked position. In the locked position, the lanyard spool is restricted from rotating, and in the unlocked position, the lanyard spool is permitted to rotate with reduced interference from the locking mechanism. The locking mechanism includes biasing components that bias the locking mechanism to remain stationary unless sufficient force is exerted.

20 Claims, 7 Drawing Sheets

(56) References Cited

U.S. PATENT DOCUMENTS

| | | | | |
|---|---|---|---|---|
| 6,059,213 | A | 5/2000 | Phillips | |
| 6,179,238 | B1 | 1/2001 | Phillipps | |
| 6,536,697 | B2 | 3/2003 | Tsan | |
| 7,295,984 | B2 | 11/2007 | Glynn | |
| 7,374,123 | B2 | 5/2008 | Han | |
| 7,395,984 | B2 | 7/2008 | Szarkowski et al. | |
| 7,424,997 | B2 | 9/2008 | Achtari et al. | |
| 7,458,488 | B2 | 12/2008 | Bass et al. | |
| 7,857,099 | B2 | 12/2010 | Choate | |
| 8,746,519 | B2 | 6/2014 | Young et al. | |
| 9,169,972 | B2 | 10/2015 | Hesl et al. | |
| 9,242,128 | B2 | 1/2016 | Macy | |
| 2005/0045676 | A1 | 3/2005 | Bass et al. | |
| 2006/0163412 | A1* | 7/2006 | Szarkowski ..... | B65H 75/4434 242/384 |
| 2006/0283081 | A1 | 12/2006 | Killen | |
| 2008/0054116 | A1* | 3/2008 | Han ..... | B65H 75/4431 242/385.2 |
| 2008/0105779 | A1 | 5/2008 | Han | |
| 2009/0084697 | A1 | 4/2009 | Gross | |
| 2009/0242595 | A1 | 10/2009 | Gross | |
| 2010/0116922 | A1 | 5/2010 | Choate et al. | |
| 2010/0020676 | A1 | 8/2010 | Salentine et al. | |
| 2010/0206922 | A1 | 8/2010 | Gross et al. | |
| 2011/0174852 | A1* | 7/2011 | Young ..... | A45F 5/02 224/268 |
| 2015/0157116 | A1 | 6/2015 | Williams | |
| 2019/0091495 | A1 | 3/2019 | Zwart | |
| 2020/0205380 | A1 | 7/2020 | Chung | |

FOREIGN PATENT DOCUMENTS

| | | | |
|---|---|---|---|
| DE | 3323716 | | 5/1984 |
| DE | 29903185 | | 5/1999 |
| DE | 19930092 | * | 1/2001 |
| EP | 0193253 | | 9/1989 |
| KR | 10-1441049 | | 9/2014 |
| WO | WO 2007/080360 | | 7/2007 |
| WO | WO07116202 | | 10/2007 |
| WO | WO10081202 | | 7/2010 |
| WO | WO18140356 | | 8/2018 |

* cited by examiner

LANYARD WITH LOCKING ARM

CROSS-REFERENCE TO RELATED PATENT APPLICATION

The present application is a continuation of International Application No. PCT/US2021/041929, filed Jul. 16, 2021, which claims the benefit of and priority to U.S. Provisional Application No. 63/053,068, filed on Jul. 17, 2020, and U.S. Provisional Application No. 63/092,057, filed on Oct. 15, 2020, each of which are incorporated herein by reference in their entirety.

BACKGROUND OF THE INVENTION

The present invention relates generally to the field of tools. The present invention relates specifically to a lanyard for connecting tools, protective equipment, tool batteries, other construction devices/equipment, etc. to an anchor point, for example, while working at height. Lanyards are used to attach and/or support tools, batteries, components, and/or other equipment to provide security when an operator inadvertently drops the equipment. Lanyards also protect the tool or equipment from damage due to a fall.

SUMMARY OF THE INVENTION

According to one embodiment, a lanyard includes a housing, a reel, an elongate structure (e.g., tether or rope), a first coupling mechanism, a second coupling mechanism, a retraction system, and an arm. The housing includes an opening. The reel is rotatably mounted within the housing. The elongate structure is wound around the reel, and the elongate structure includes an inner end coupled to the reel and an opposing outer end extending out of the opening. The first coupling mechanism is coupled to the outer end of the elongate structure. The second coupling mechanism is coupled to the housing. The retraction system coupled to the reel, and the retraction system biases the elongate structure to be rewound onto the reel. The arm is coupled to the housing. The arm includes a body, a first end of the body, and an opposing second end of the body. The arm actuates between a locked position and an unlocked position. In the locked position, the first end extends out of the housing and the second end does not extend out of the housing, and the arm interfaces with the reel to bias the reel from rotating when the arm is in the locked position. In the unlocked position, the second end extends out of the housing and the first end does not extend out of the housing, and the arm does not bias the reel from rotating when the arm is in the unlocked position.

According to another embodiment, a lanyard includes a housing, a reel, an elongate structure, a first coupling mechanism, a second coupling mechanism, an arm, and an arm biasing system. The housing includes an opening. The reel is rotatably mounted within the housing. The elongate structure is wound around the reel, and the elongate structure includes an inner end coupled to the reel and an opposing outer end extending out of the opening. The first coupling mechanism is coupled to the outer end of the elongate structure. The second coupling mechanism is coupled to the housing. The arm is slideably coupled to the housing, and the arm actuates between a locked position and an unlocked position. The arm interfaces with the reel when in the arm is in the locked position to bias the reel from rotating. The arm biasing system biases the arm to remain in the locked position and also biases the arm to remain in the unlocked position.

According to another embodiment, a lanyard includes a housing, a reel, an elongate structure, a first coupling mechanism, an arm, and an arm lock mechanism. The reel is rotatably mounted within the housing. The elongate structure is wound around the reel, and the elongate structure includes an inner end coupled to the reel and an opposing outer end. The reel rotates in a first direction to retract the elongate structure into the housing, and the reel rotates in an opposing second direction when the elongate structure is being pulled from the housing. The first coupling mechanism is coupled to the outer end of the elongate structure. The arm is coupled to the housing, and the arm actuates between a locked position and an unlocked position. The arm interfaces with the reel when in the arm is in the locked position to bias the reel from rotating in the second direction. The arm lock mechanism biases the arm to remain in the locked position. The arm transitions from the locked position to the unlocked position in response to the elongate structure receiving a pulling force greater than a threshold amount of force.

According to one embodiment, a lanyard includes a housing defining an opening, a reel rotatably mounted within the housing, an elongate structure wound around the spool, the elongate structure having an inner end coupled to the spool and an outer end extending out of the opening, an arm, and a retraction system coupled to the spool, the retraction system drives rewinding of the elongate structure on to the reel. The arm includes a first end and opposing second end. The arm actuates between a locked position in which the first end extends out of the housing and the second end does not extend out of the housing, and an unlocked position in which the second end extends out of the housing and the first end does not extend out of the housing. A protrusion extends from the arm and interfaces with the spool to interfere with the spool rotating when the arm is in the locked position, and the protrusion does not interface with the spool when the arm is in the unlocked position.

According to another embodiment, a lanyard includes a housing including an opening, a spool rotatably mounted within the housing, an elongate structure wound around the spool, the elongate structure having an inner end coupled to the spool and an outer end extending out of the opening, a retraction system coupled to the spool, wherein the retraction system drives rewinding of the elongate structure on to the spool, an arm that actuates between an unlocked position and a locked position, and an arm lock mechanism that biases the arm to remain stationary relative to the spool. The arm interfaces with the spool when the arm is in the locked position, thereby interfering with the spool rotating. When the arm is in the unlocked position, the arm lock mechanism biases the arm to remain in the unlocked position, and when the arm is in the locked position the arm lock mechanism biases the arm to remain in the locked position. In a specific embodiment, the arm lock mechanism includes a detent ball biased by a spring to interface with a recess defined by the arm.

Additional features and advantages will be set forth in the detailed description, which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION

Figure 1:
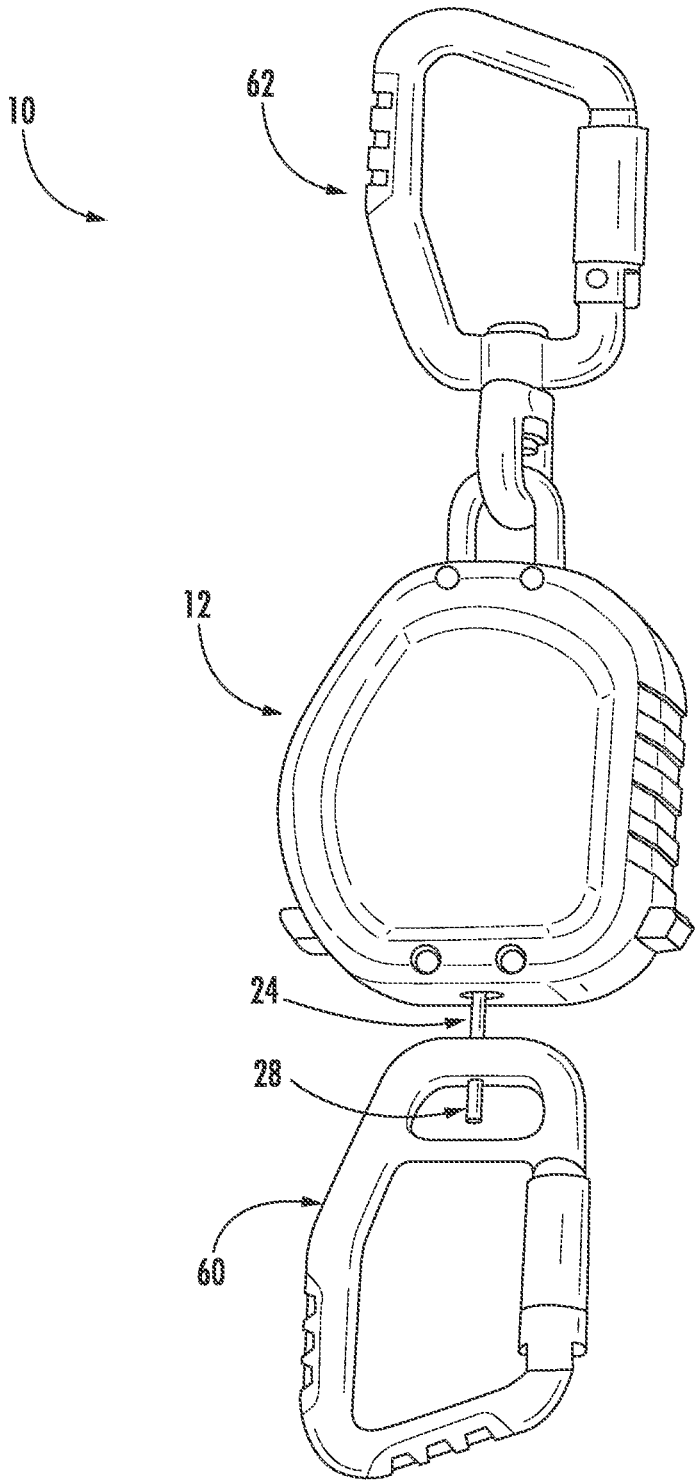
FIG. 1 is a perspective view of a lanyard, according to an embodiment.
Figure 2:
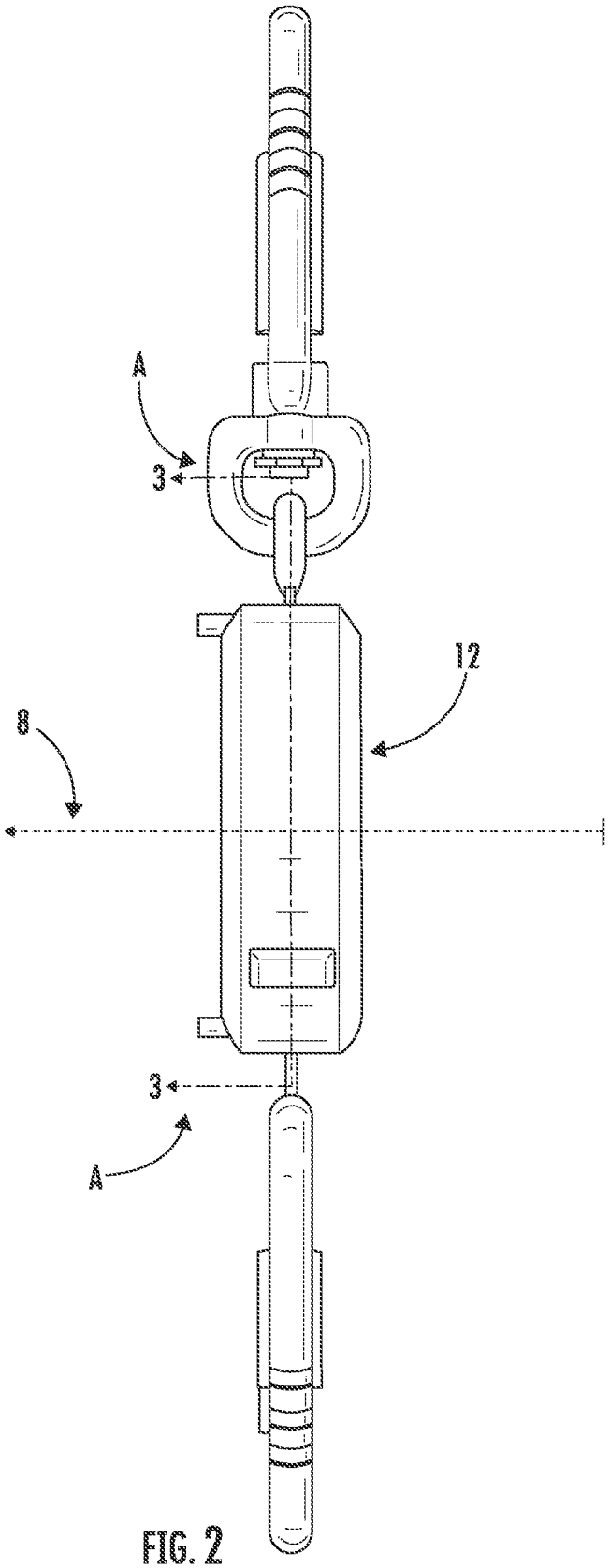
FIG. 2 is a side view of the lanyard of FIG. 1, according to an exemplary embodiment.

Referring generally to the figures, various embodiments of a lanyard are shown. Lanyards are used as a safety measure to secure tools/equipment to an anchor point, for example, while working at height. To enhance safety, a lanyard may couple to tools, protective equipment, tool batteries, other construction devices/equipment, etc. and tether them when operating the tools at height. Various regulations (e.g., OSHA regulations) may require a lanyard when an operator uses a tool at height. When a tool is dropped at height, the lanyard couples the tool to an anchor point and prevents the tool from dropping further than a distance provided by the lanyard. This prevents a safety hazard and also protects the tool from the damage that may be otherwise caused by the fall.

Applicant has developed an innovative locking/biasing mechanism that restricts movement of the lanyard spool. When the locking mechanism is in the locked position, the lanyard spool is biased from rotating unless a sufficient pulling force is exerted on the cord, in which case the locking mechanism disengages from the lanyard spool. This disengagement functionality permits the lanyard cord to be extended without requiring the user to directly interface with and actuate the locking mechanism. When the locking mechanism is in the unlocked position, the lanyard spool is permitted to rotate without interference from the locking mechanism. The locking mechanism includes locking components that bias the locking mechanism to remain stationary when in the locked and the unlocked positions.

Referring to FIGS. 1-4, various aspects of a device, shown as lanyard 10, are shown. Lanyard 10 includes a first retractable coupling mechanism, shown as carabiner 60, and a second fixed coupling mechanism, shown as carabiner 62, coupled to housing 12. Both carabiner 60 and carabiner 62 are coupled to housing 12. Housing 12 includes an opening 14. An elongate flexible structure, shown as cord 24, has an inner end 26 coupled to spool 20 and an opposing outer end 28 extending out of opening 14. Carabiner 60 is coupled to outer end 28 of cord 24. Cord 24 is extendable and retractable from housing 12, thereby reducing and increasing the distance that carabiner 60 may be separated from housing 12. Carabiner 62 is coupled to housing 12 such that the carabiner 62 and housing 12 remain a relatively fixed distance from each other.

In use, carabiner 60 is coupled to items such as tools, protective equipment, tool batteries, other construction devices/equipment, etc. Carabiner 62 anchors lanyard 10 to an anchor point, such as a belt, scaffold, etc. If and when the item coupled to carabiner 60 is dropped, lanyard 10 anchors the item to the anchor point to which carabiner 62 is coupled.

Spool 20 is rotatably coupled to housing 12 (e.g., rotatably mounted within housing 12) such that spool 20 rotates around axis 8 with respect to housing 12. In a specific embodiment, spool 20 is a reel. An elongate structure, shown as cord 24, is wound around spool 20. As cord 24 is extracted from housing 12 through opening 14, spool 20 rotates around axis 8 in a second rotational direction, shown as direction 48. Spool 20 rotates in a first direction, opposite direction 48, when the cord 24 to retract cord 24 within housing 12 and onto spool 20. Retraction system 30 biases spool 20 opposite rotational direction 48, thereby biasing cord 24 towards being retracted within housing 12 onto spool 20. In a specific embodiment retraction system 30 includes a spring, such as a spiral spring. In a specific embodiment, retraction system 30 is coupled to spool 20 and retraction system 30 biases cord 24 to be rewound onto spool 20. In a specific embodiment, arm 32 interfacing with spool 20 when arm 32 is in the locked position biases spool 20 from rotating, such as rotating in the direction opposite rotational direction 48. In a specific embodiment, arm 32 is a shuttle that slides linearly with respect to housing 12.

In another embodiment, the configuration of the lanyard is flipped and thus in the reverse arrangement. For example, as cord 24 is extracted from housing 12, spool 20 rotates around axis 8 opposite rotational direction 48, tooth 38 of arm are on the right side of arm 32, and arm 32 is in the locked position when arm 32 is extending out the left-side of housing (from the perspective of FIG. 3).

Arm 32 actuates along linear axis 40 such that when arm 32 is in the locked position (best shown FIG. 3), a protrusion from arm 32, shown as tooth 38, interfaces with teeth 22 of spool 20. When tooth 38 and teeth 22 interface, arm 32 resists spool 20 rotating in either direction 48 or opposite direction 48. Stated another way, arm 32 interfaces with spool 20 when arm 32 is in the locked position to bias the spool 20 from rotating. When arm 32 is in the unlocked position (best shown FIG. 4), tooth 38 of arm 32 does not interface with teeth 22 of spool 20, so arm 32 no longer resists spool 20 rotating. In a specific embodiment, arm 32 is slideably coupled to housing 12 such that arm 32 actuates between the locked and unlocked position via arm 32 sliding with respect to housing 12. In a specific embodiment, arm 32 includes body 33, first end 34 of body 33, and opposing second end 36 of body 33 opposite first end 34.

Figure 3:
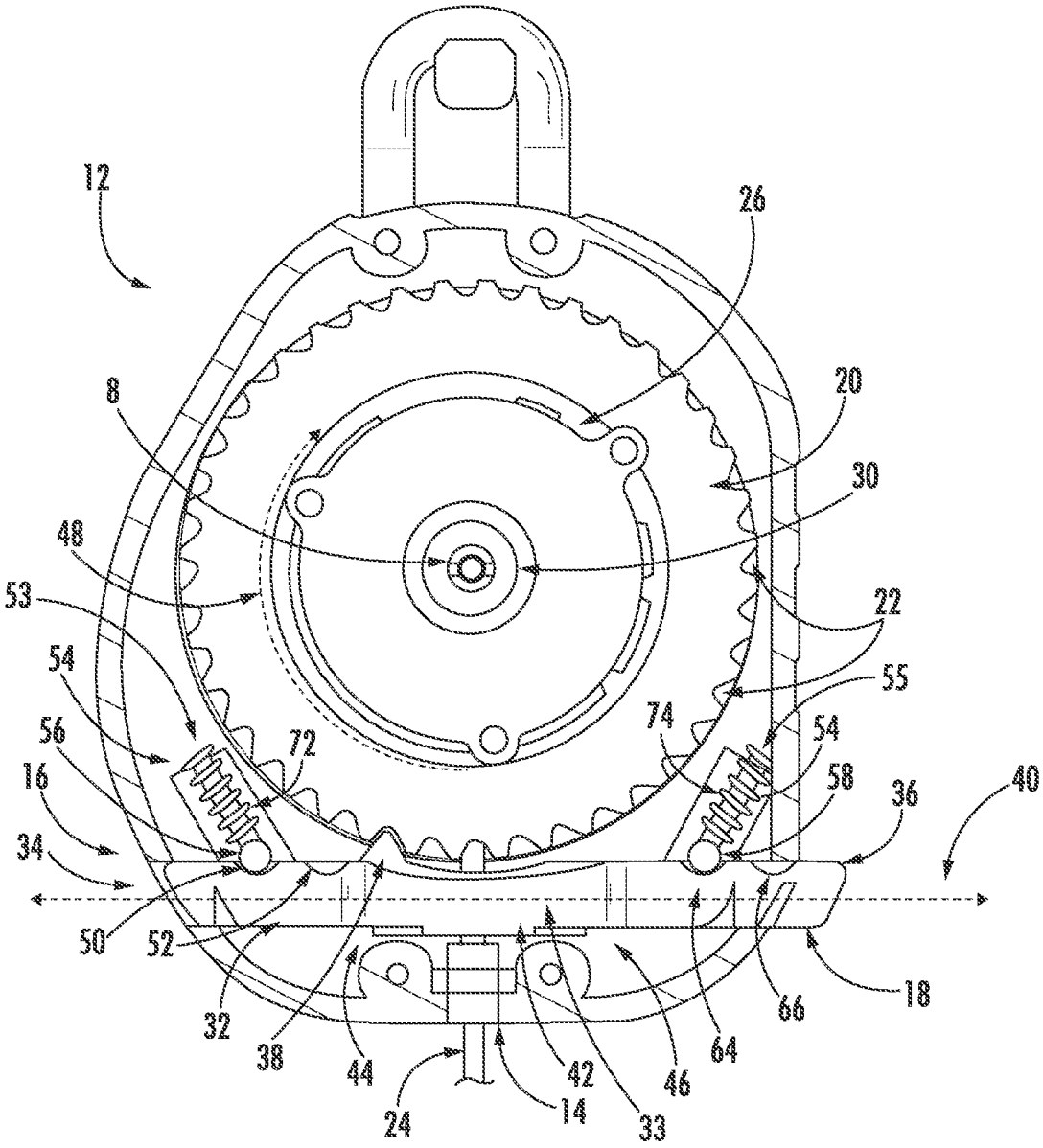
FIG. 3 is a cross-section view of the lanyard of FIG. 1 taken along line 3-3 in FIG. 2, according to an exemplary embodiment.
Figure 4:
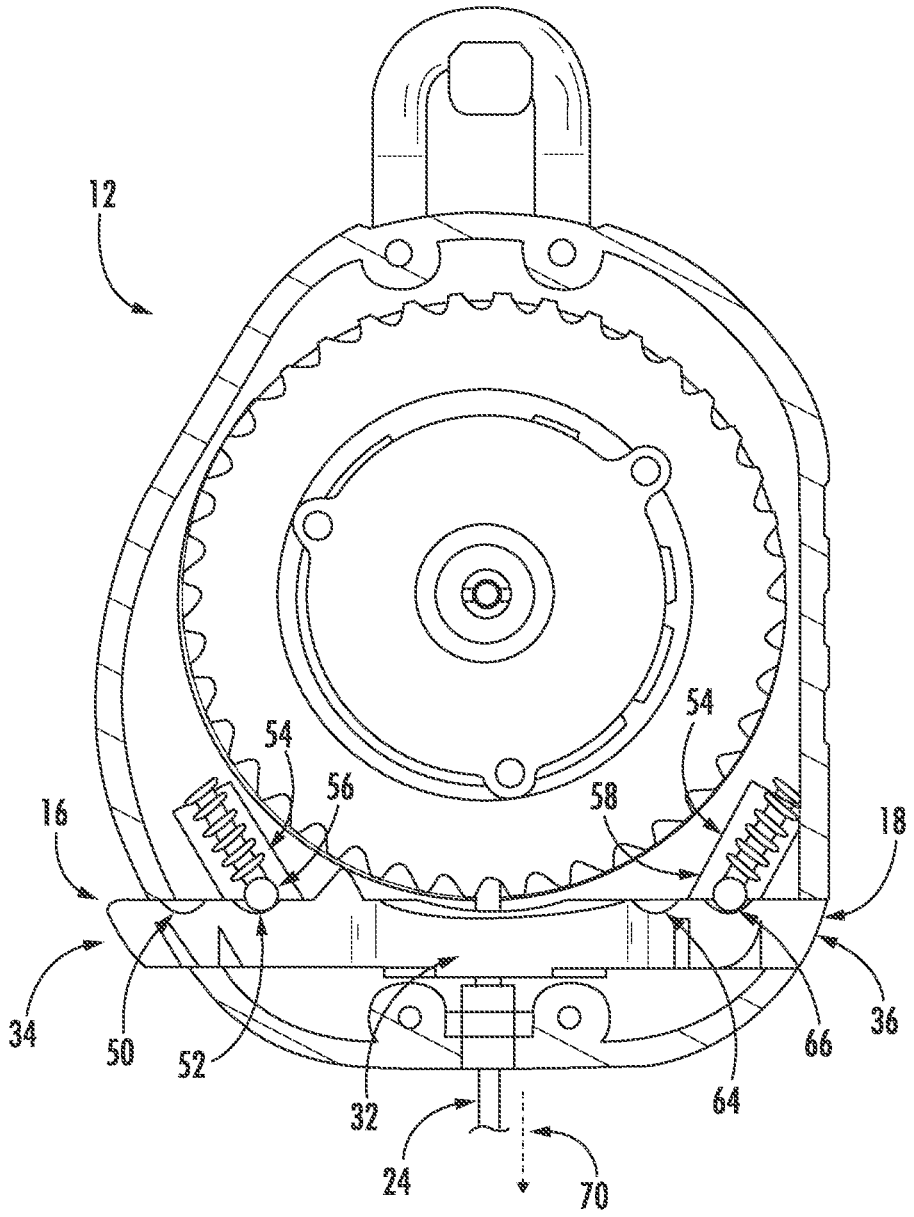
FIG. 4 is another cross-section view of the lanyard of FIG. 1 taken along line 3-3 in FIG. 2, in which the arm is in a different position than in FIG. 3, according to an exemplary embodiment.

A first biasing component, shown as a spring-biased ball 56, and a second biasing component, also shown as a spring-biased ball 58, selectively resist arm 32 actuating between the locked position (FIG. 3) and the unlocked position (FIG. 4). When arm 32 is in the locked position (FIG. 3), spring-biased ball 56 interfaces with recess 50 and spring-biased ball 58 interfaces with recess 64, thereby biasing arm 32 to remain in the locked position.

To actuate arm 32 from the locked position to the unlocked position, a user can exert a force on second end 36 of arm 32 sufficient to overcome the biasing forces of spring-biased ball 56 and spring-biased ball 58. When sufficient force is exerted on second end 36 of arm 32, arm 32 moves from the locked position (FIG. 3) to the unlocked position (FIG. 4) until first end 34 of arm 32 extends from opening 16 of housing 12 and second end 36 of arm 32 no longer extends from opening 18 of housing 12. When arm 32 is in the unlocked position (FIG. 4), spring-biased ball 56 interfaces with recess 52, and spring-biased ball 58 interfaces with recess 66, thereby biasing arm 32 to remain in the unlocked position.

In a specific embodiment, when arm 32 is in the locked position, first end 34 of arm 32 extends out of housing 12 and second end 36 does not extend out of housing 12, and arm 32 interfaces with spool 20 to bias spool 20 from rotating when arm 32 is in the locked position. In a specific embodiment, when arm 32 is in the unlocked position, second end 36 extends out of housing 12 and first end 34 does not extend out of housing 12, and arm 32 does not bias spool 20 from rotating when the arm 32 is in the unlocked position.

In a specific embodiment, arm 32 transitions from the locked position to the unlocked position in response to cord 24 receiving a pulling force (e.g., a force in direction 70; see FIG. 4) greater than a threshold amount of force (e.g., an amount of force sufficient to overcome the biasing forces of arm biasing system 54). For example, when cord 24 receives the threshold amount of force, teeth 22 of spool 20 interface with tooth 38 to push arm 32 to the unlocked position (e.g., to the left as seen in FIGS. 3 and 4).

In another embodiment, when arm 32 is in the locked position then arm 32 extends from both ends of housing 12, and when arm 32 is in the unlocked position then arm 32 extends from both ends of housing 12.

Alternatively, exerting sufficient force on cord 24 actuates arm 32 from the locked position to the unlocked position. As a pulling force is exerted on cord 24 relative to housing 12, cord 24 exerts a corresponding rotational force in direction 48 on spool 20. When sufficient force is exerted on spool 20, teeth 22 of spool 20 push tooth 38 of arm 32 to the left (from the perspective of FIG. 3) along linear axis 40. Thus, if sufficient pulling force is exerted on cord 24, arm 32 will be actuated from the locked position (FIG. 3).

In a specific embodiment, arm biasing system 54 includes first arm-biasing mechanism 53 and second arm-biasing mechanism 55. Arm biasing system 54 biases arm 32 to remain in the locked position and arm biasing system 54 biases arm 32 to remain in the unlocked position. First arm-biasing mechanism 53 includes first spring-biased ball 56 and a first biasing element, shown as spring 72, that biases first spring-biased ball 56 against arm 32. Second arm-biasing mechanism 55 includes second spring-biased ball 58 and a second biasing element, shown as spring 74, that biases second spring-biased ball 58 against arm 32.

In a specific embodiment, each of first arm-biasing mechanism 53 and second arm-biasing mechanism 55 include a detent that interfaces with one of spring-biased ball 56, 58. In various embodiments, first arm-biasing mechanism 53 biases arm 32 to remain in the locked position, and second arm-biasing mechanism 55 biases arm 32 to remain in the unlocked position. In a specific embodiment, first arm-biasing mechanism 53 further biases arm 32 to remain in the unlocked position in addition to biasing arm 32 to remain in the locked position. In a specific embodiment, second arm-biasing mechanism 55 further biases arm 32 to remain in the locked position in addition to biasing arm 32 to remain in the unlocked position.

In an alternate embodiment, arm biasing system 54 only includes one of first arm-biasing mechanism 53 and second arm-biasing mechanism 55 (e.g., only one spring-biased ball 56 and only one spring-biased ball 58).

In a specific embodiment, arm 32 includes a hard-stop, shown as lower protrusion 42, that restricts the range of sliding motion by arm 32. Lower protrusion 42 of arm 32 interfaces with left wall 44 and right wall 46 of housing 12, to restrict arm 32 to positions between the locked position (FIG. 3) and the unlocked position (FIG. 4). In another embodiment arm 32 does not include lower protrusions 42 that interfaces left wall 44 and right wall 46 of housing 12.

Figure 5:
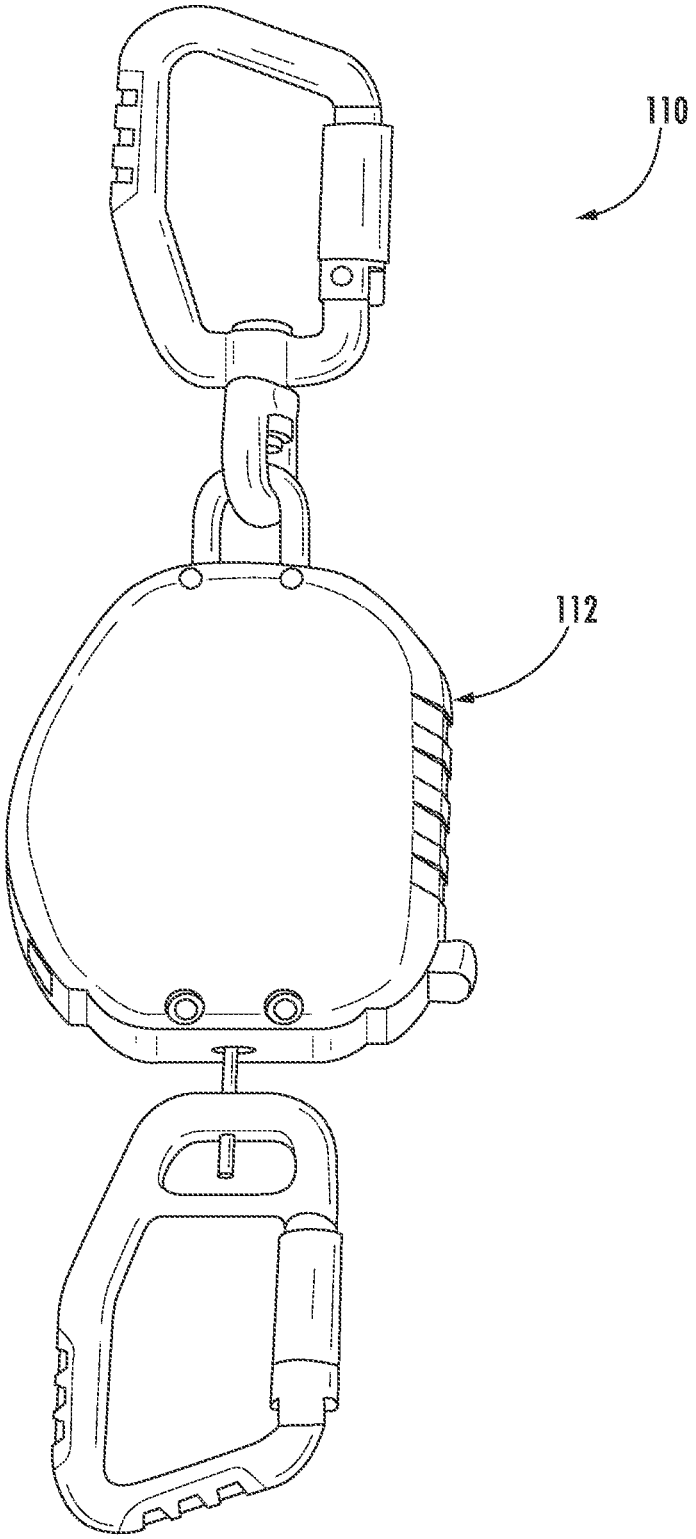
FIG. 5 is a side view of a lanyard, according to another embodiment.
Figure 6:
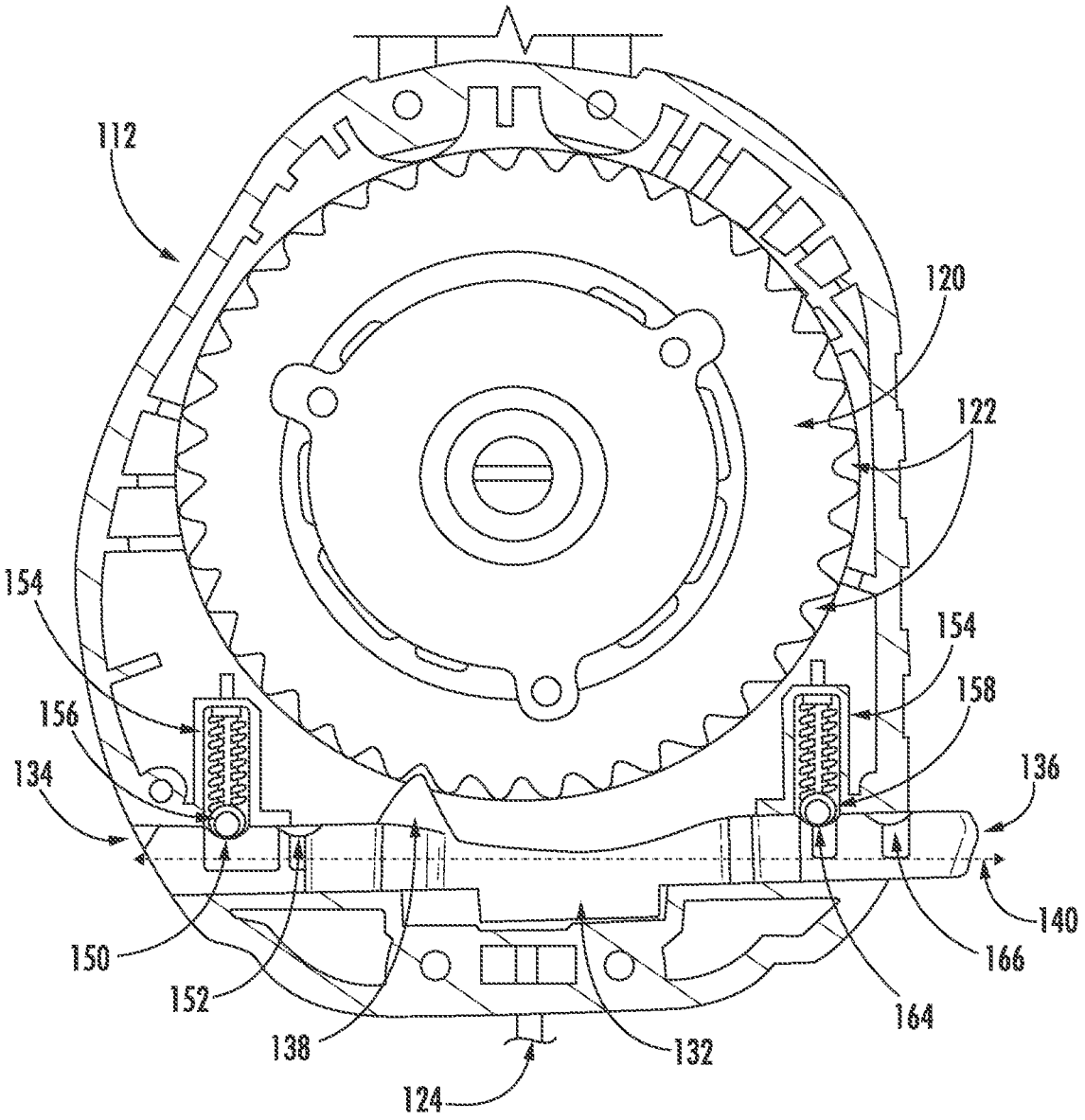
FIG. 6 is a cross-section view of the lanyard of FIG. 5, according to an exemplary embodiment.

Referring to FIG. 5 and FIG. 6, a lanyard 110 is shown according to an exemplary embodiment. Lanyard 110 is similar to lanyard 10 with the exception of the differences described.

Lanyard 110 includes a first locking component, shown as a spring-biased ball 156, and a second locking component, shown as a spring-biased ball 158. Spring-biased balls 156 and 158 operate to selectively resist movement of arm 132 along axis 140. Arm 132 actuates along axis 140 with respect to housing 112 between a locked position (FIG. 5) and an unlocked position, and spring-biased balls 156 and 158 retain arm 132 in the locked or unlocked position following selection of the position by the user.

When arm 132 is in the locked position (FIG. 5), spring-biased ball 156 interfaces with recess 150 and spring-biased ball 158 interfaces with recess 164. and In this position, the engagement of spring-biased balls 156 and 158 with recesses 150 and 164 acts to retain arm 132 in the locked position. When arm 132 is in the unlocked position, spring-biased ball 156 interfaces with recess 152 and spring-biased ball 158 interfaces with recess 166. In this position, the engagement of spring-biased balls 156 and 158 with recesses 152 and 166 acts to retain arm 132 in the unlocked position.

To actuate arm 132 from the locked position to the unlocked position, a user can exert a force on second end 136 of arm 132 sufficient to overcome the biasing forces of spring-biased ball 156 and of spring-biased ball 158. When sufficient force is exerted on second end 136 of arm 32, arm 132 moves from the locked position (FIG. 5) to the unlocked position until first end 134 of arm 132 extends from housing 112 and second end 136 of arm 132 no longer extends from housing 112.

Alternatively, exerting sufficient force on cord 124 actuates arm 132 from the locked position to the unlocked position. As a pulling force is exerted on cord 124 relative to housing 112, cord 124 exerts a corresponding rotational force on spool 120. When sufficient force is exerted on spool 120, teeth 122 of spool 120 push tooth 138 of arm 132 to the left (from the perspective of FIG. 6) along linear axis 140. Thus, if sufficient pulling force is exerted on cord 124, arm 132 will be actuated from the locked position (FIG. 6).

Figure 7:
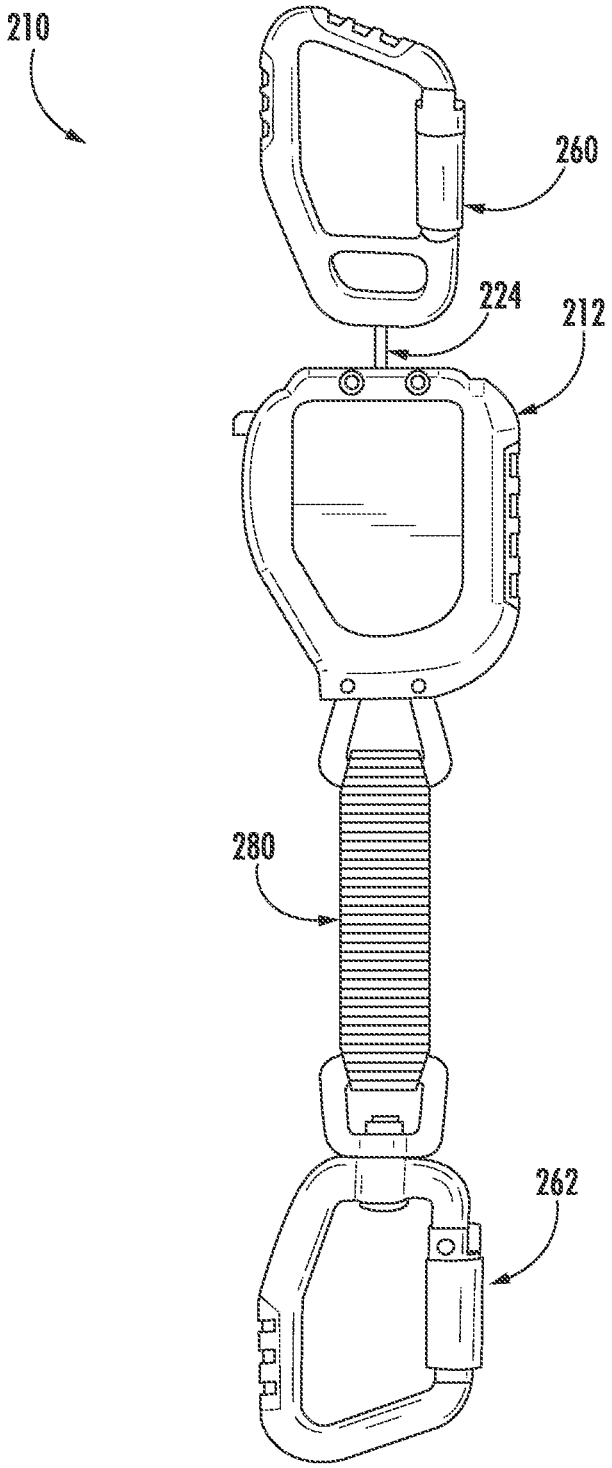
FIG. 7 is a side view of a lanyard, according to another embodiment.

Referring to FIG. 7, a lanyard 210 is shown according to an exemplary embodiment. Lanyard 210 is similar to lanyard 10 or lanyard 110 with the exception of the differences described.

Lanyard 210 includes fixed coupling unit 262 coupled to housing 212 via flexible coupler 280. In a specific embodiment, flexible coupler 280 is formed from a fabric material. Applicant has observed that flexible coupler 280, such as when flexible coupler 280 is formed from a fabric material, absorbs some of the shock load during drop events (e.g., when the object coupled to retractable coupling unit 260 is dropped), thereby reducing the load on the components within lanyard 210 and correspondingly reducing the likelihood of components within lanyard 210 being broken and/or damaged.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

The invention claimed is:

1. A lanyard comprising:

a housing comprising an opening;

a reel rotatably mounted within the housing;

an elongate structure wound around the reel, the elongate structure having an inner end coupled to the reel and an opposing outer end extending out of the opening;

a first coupling mechanism coupled to the outer end of the elongate structure;

a second coupling mechanism coupled to the housing;

a retraction system coupled to the reel, wherein the retraction system biases the elongate structure to be rewound onto the reel; and an arm coupled to the housing, the arm comprising a body, a first end of the body, and an opposing second end of the body, wherein the arm actuates between:

a locked position in which the first end extends out of the housing and the second end does not extend out of the housing, the arm interfacing with the reel to bias the reel from rotating when the arm is in the locked position; and an unlocked position in which the second end extends out of the housing and the first end does not extend out of the housing, wherein the arm does not bias the reel from rotating when the arm is in the unlocked position.

2. The lanyard of claim 1, wherein the arm transitions from the locked position to the unlocked position in response to the elongate structure receiving a pulling force greater than a threshold amount of force.

3. The lanyard of claim 1, further comprising:

a first arm biasing mechanism that biases the arm to remain in the locked position; and a second arm biasing mechanism that biases the arm to remain in the unlocked position.

4. The lanyard of claim 3, the first arm biasing mechanism comprises a first ball and a first spring that biases the first ball against the arm, and the second arm biasing mechanism comprises a second ball and a second spring that biases the second ball against the arm.

5. The lanyard of claim 1, further comprising a flexible coupler that couples the second coupling mechanism to the housing.

6. The lanyard of claim 5, wherein the flexible coupler is formed from a fabric material.

7. The lanyard of claim 1, wherein the retraction system comprises a spring.

8. The lanyard of claim 1, wherein the arm actuates between the locked position and the unlocked position via the arm sliding with respect to the housing.

9. A lanyard comprising:

a housing comprising an opening;

a reel rotatably mounted within the housing;

an elongate structure wound around the reel, the elongate structure having an inner end coupled to the reel and an opposing outer end extending out of the opening;

a first coupling mechanism coupled to the outer end of the elongate structure;

a second coupling mechanism coupled to the housing;

an arm slideably coupled to the housing, the arm actuating between a locked position and an unlocked position, the arm interfacing with the reel when in the arm is in the locked position to bias the reel from rotating; and an arm biasing system that biases the arm to remain in the locked position and that biases the arm to remain in the unlocked position, the arm biasing system comprising a first spring, wherein at least a part of the first spring is located between a top surface of the arm and the reel.

10. The lanyard of claim 9, wherein the arm biasing system comprises:

a first arm biasing mechanism that biases the arm to remain in the locked position, the first arm biasing mechanism comprising the first spring; and a second arm biasing mechanism that biases the arm to remain in the unlocked position, the second arm biasing mechanism comprising a second spring.

11. The lanyard of claim 10, wherein the first arm biasing mechanism further biases the arm to remain in the unlocked position.

12. The lanyard of claim 11, wherein the second arm biasing mechanism further biases the arm to remain in the locked position.

13. The lanyard of claim 9, further comprising a retraction system coupled to the reel, wherein the retraction system biases the elongate structure to be rewound onto the reel.

14. The lanyard of claim 9, wherein the arm actuates between the locked position and the unlocked position via the arm sliding with respect to the housing.

15. A lanyard comprising:

a housing;

a reel rotatably mounted within the housing;

an elongate structure wound around the reel, the elongate structure having an inner end coupled to the reel and an opposing outer end, the reel rotating in a first direction to retract the elongate structure into the housing, and the reel rotating in an opposing second direction when the elongate structure is being pulled from the housing;

a first coupling mechanism coupled to the outer end of the elongate structure;

an arm coupled to the housing, the arm including a first recess and a second recess, the arm actuating between a locked position and an unlocked position, the arm interfacing with the reel when in the arm is in the locked position to bias the reel from rotating in the second direction; and an arm lock mechanism that interfaces with the first recess when in the locked position to bias the arm to remain in the locked position and interfaces with the second recess when in the unlocked position to bias the arm to remain in the unlocked position, wherein the arm transitions from the locked position to the unlocked position in response to the elongate structure receiving a pulling force greater than a threshold amount of force.

16. The lanyard of claim 15, the arm comprising a first end and an opposing second end, wherein when the arm is in the locked position the first end extends out of the housing and the second end does not extend out of the housing, and when the arm is in the unlocked position the second end extends out of the housing and the first end does not extend out of the housing.

17. The lanyard of claim 15, further comprising an arm biasing system that biases the arm to remain in the locked position and that biases the arm to remain in the unlocked position.

18. The lanyard of claim 17, wherein the first recess and the second recess are located on a left portion of the arm, and wherein the arm further comprises a third recess and a fourth recess located on a right portion of the arm, wherein the arm biasing system interfaces with the third recess when in the locked position to bias the arm to remain in the locked position and interfaces with the fourth recess when in the unlocked position to bias the arm to remain in the unlocked position.

19. The lanyard of claim 15, wherein the arm actuates between the locked position and the unlocked position via the arm sliding with respect to the housing.

20. The lanyard of claim 15, wherein when the elongate structure receives the threshold amount of force, the reel interfaces with the arm to move the arm from the locked position into the unlocked position.

* * * * *